US005880756A

United States Patent [19]

Ishii et al.

[11] Patent Number: 5,880,756

[45] Date of Patent: Mar. 9, 1999

[54] INK JET RECORDING HEAD

[75] Inventors: Takayuki Ishii; Kohei Kitahara, both of Suwa, Japan

[73] Assignee: Seiko Epson Corporation, Tokyo, Japan

[21] Appl. No.: 365,160

[22] Filed: Dec. 28, 1994

[30] Foreign Application Priority Data

| | | | |
|---|---|---|---|
| Dec. 28, 1993 | [JP] | Japan | 5-351687 |
| Aug. 2, 1994 | [JP] | Japan | 6-200119 |

[51] Int. Cl.[6] ..... B41J 2/145; B41J 2/15

[52] U.S. Cl. ..... 347/40; 347/41

[58] Field of Search ..... 347/40, 71, 93, 347/68, 70, 72, 41

[56] References Cited

U.S. PATENT DOCUMENTS

| | | | |
|---|---|---|---|
| 3,747,120 | 7/1973 | Stemme | 347/70 |
| 3,946,398 | 3/1976 | Kyser et al. | 347/70 |
| 4,014,029 | 3/1977 | Lane et al. | 347/40 |
| 4,528,575 | 7/1985 | Matsuda et al. | 347/71 |
| 4,680,595 | 7/1987 | Cruz-Uribe et al. | 347/71 |
| 4,695,854 | 9/1987 | Cruz-Uribe | 346/140 R |
| 4,730,197 | 3/1988 | Raman et al. | 347/40 |
| 4,766,671 | 8/1988 | Utsumi et al. | 347/71 |
| 4,769,654 | 9/1988 | Tanaka et al. | 347/70 |
| 4,855,752 | 8/1989 | Bergstedt | 347/43 |
| 4,937,597 | 6/1990 | Yasuhara et al. | 346/140 |
| 5,126,615 | 6/1992 | Takeuchi et al. | 310/330 |
| 5,128,694 | 7/1992 | Kanayama | 347/72 |
| 5,289,209 | 2/1994 | Suzuki et al. | 347/71 |
| 5,359,354 | 10/1994 | Hiraishi et al. | 347/69 |
| 5,367,324 | 11/1994 | Abe et al. | 347/43 |
| 5,376,856 | 12/1994 | Takeuchi et al. | 310/328 |
| 5,402,926 | 4/1995 | Takeuchi et al. | 228/174 |
| 5,462,412 | 10/1995 | Matsuda | 347/43 |
| 5,475,279 | 12/1995 | Takeuchi et al. | 310/328 |

FOREIGN PATENT DOCUMENTS

| | | | |
|---|---|---|---|
| WO 89/07752 | 8/1989 | European Pat. Off. . | |
| 0 426 473 A3 | 5/1991 | European Pat. Off. . | |
| 0426473 | 5/1991 | European Pat. Off. | B41J 2/14 |
| 0 443 628 A2 | 8/1991 | European Pat. Off. . | |
| 0554907 | 8/1993 | European Pat. Off. | B41J 2/15 |
| 554907 | 8/1993 | European Pat. Off. | B41J 2/15 |
| 0 572 230 A2 | 12/1993 | European Pat. Off. | 347/71 |
| 0572231 | 12/1993 | European Pat. Off. | B41J 2/14 |
| 0 584 823 A1 | 3/1994 | European Pat. Off. | 347/71 |

(List continued on next page.)

OTHER PUBLICATIONS

Patent Abstracts of Japan, vol. 10, No. 270 (M–517), Sep. 13, 1986, & JP–A–61 092863 (Fujitsu LTD) May 10, 1986, *abstract.

*Primary Examiner*—N. Le
*Assistant Examiner*—Thinh Nguyen
*Attorney, Agent, or Firm*—Sughrue, Mion, Zinn, Macpeak & Seas, PLLC

[57] ABSTRACT

An ink jet recording head that is formed by laminating a plurality of thin plate members, each having a plurality of holes. The holes of the adjacently stacked thin plate members cooperate to form ink flow paths each continuously extending to communicate a nozzle opening with a respective pressure producing chamber, which is connected to an ink supply section. In such ink jet recording head, the holes can be aligned or shifted with respect to each other, and allow ink to flow smoothly, thus preventing stagnation of air bubbles contained in the ink within the print head. Further, the nozzles openings are arranged in arrays in an auxiliary scanning direction. The nozzle opening arrays are divided into three groups spaced apart from each other at a predetermined interval in a main scanning direction. Nozzle openings belonging to groups arranged on both sides of the middle group are positioned vertically between adjacent nozzle openings of the middle group. A nozzle opening of the middle group is positioned uppermost or lowermost in the auxiliary scanning direction, so that lines printed by the nozzle openings belonging to the groups arranged at both sides interpose a line printed by the nozzle openings of the middle group to reducing inter-line error due to misalignment of the recording head with respect to a printing sheet.

6 Claims, 10 Drawing Sheets

FOREIGN PATENT DOCUMENTS

| | | | |
|---|---|---|---|
| 3208104 | 9/1983 | Germany | B41J 3/10 |
| 36 28 346 A1 | 2/1988 | Germany . | |
| 3208104 | 9/1993 | Germany | B41J 2/51 |
| 58-116163 | 7/1983 | Japan . | |
| 60-232967 | 11/1985 | Japan . | |
| 62-101455 | 5/1987 | Japan . | |
| 62-111758 | 5/1987 | Japan . | |
| 62-213399 | 9/1987 | Japan . | |
| 63-149159 | 6/1988 | Japan . | |
| 3-128681 | 5/1991 | Japan . | |
| 3-64311 | 10/1991 | Japan . | |
| 5-147210 | 6/1993 | Japan | 347/71 |
| 5-318735 | 12/1993 | Japan . | |
| 2182611 | 5/1987 | United Kingdom | B41J 3/04 |

INK JET RECORDING HEAD

BACKGROUND OF THE INVENTION

1. Field of the Invention

The invention relates to an ink jet recording head having a plurality of nozzle openings disposed in a sheet forwarding direction, with each nozzle opening jetting an ink droplet due to pressure provided by a pressure producing chamber. More particularly, the invention is directed to a nozzle opening arrangement on the ink jet recording head.

2. Description of the Related Art

Ink jet recording heads are widely used throughout the printing industry. Such ink jet recording heads exhibit high recording density, are capable of printing dots of various sizes, and are relatively quiet during operation.

Two basic types of ink jet recording heads exist. A bubble jet type recording head uses thermal energy provided by a heater to effect printing. On the other hand, in a piezoelectric vibration element driven recording head, the displacement of piezoelectric vibration elements causes ink to be omitted to effect printing.

Two general types of piezoelectric vibration element driven recording heads exist. In the first type, vertical vibration of the piezoelectric vibration elements causes ink to be emitted. In the second type, flexural vibration of the piezoelectric vibration elements causes ink to be emitted.

In the first type of piezoelectric vibration element driven recording heads, the area in which a piezoelectric vibration element abuts against the vibration plate can be reduced. Hence, the interval between the nozzle opening arrays can easily be made small. However, the process for assembling such a recording head is complicated because each piezoelectric vibration element is extremely small.

The second type of piezoelectric vibration element driven recording heads employs a laminated structure, such as described in Japanese Unexamined Patent Publication No. 4-366643. That is, a common ink supply section, and pressure producing chambers or ink flow paths, are first formed in each of a plurality of thin plate members. These thin plate members are then sequentially laminated on the back of a nozzle plate. Accordingly, the assembly process is simple.

However, in this arrangement, each flow path extending from the pressure producing chamber to the nozzle openings is formed by making communicating holes in each thin plate member, and arranging these communicating holes proximate to one another. Hence, it is difficult to discharge the tiny air bubbles in the ink from the corners of the flow paths formed in each thin plate member.

In addition, in this arrangement, the size of the piezoelectric vibration plate mounted on the pressure producing chamber is larger than that of the piezoelectric vibration plate used as the piezoelectric vibration element in the first type of piezoelectric vibration element driven recording head. Hence, the distance between the nozzle opening arrays is increased.

If the distance between the nozzle opening arrays is increased, error between dots printed on a recording sheet in the auxiliary scanning direction tends to increase if three or more nozzle opening arrays are formed in an attempt to improve printing quality. In this case, however, printing quality is actually reduced.

That is, a recording head having a plurality of nozzle opening arrays is designed so that each nozzle opening array enables a dot to be printed at a predetermined position in the auxiliary scanning direction. As a result, this type of recording head has the uppermost nozzle opening and the lowermost nozzle opening arranged at opposite ends in the main scanning direction. This causes an error of $G \times \sin\theta$ between lines in the auxiliary scanning direction before and after sheet forwarding, assuming that the distance between the nozzle opening array at one end and the nozzle opening array at the other end in the main scanning direction is G, and the angle of inclination between the direction in which the nozzle opening arrays of the recording head extend and the sheet forwarding direction is $\theta$. This error, $G \times \sin\theta$, causes white lines and black lines to be intermingled during printing, thereby impairing painting quality.

An ink jet recording head designed to eliminate this problem is described in European Laid-open Patent Publication No. 554907. In this ink jet recording head, four nozzle opening arrays, each having a plurality of nozzle openings linearly pitched in the sheet forwarding direction at an interval corresponding to the number of nozzle opening arrays, have their positions in the main scanning direction staggered by a predetermined interval so as to be different from the physically arranged sequence thereof. This arrangement, which reduces the distance in the auxiliary scanning direction between the uppermost nozzle opening and the lowermost nozzle opening of the recording head, can prevent printing of white lines and black lines due to displacement in the angle $\theta$ between the nozzle opening array and the sheet forwarding direction.

However, this advantage is realized only when the number of nozzle opening arrays is four. Hence, such a design is applicable to a limited number of recording heads.

SUMMARY OF THE INVENTION

In view of the above problems associated with conventional ink jet recording heads, an object of the present invention is to provide a laminated type ink jet recording head which minimizes stagnation of air bubbles in its ink flow paths.

To achieve this object, the present invention provides an ink jet recording head that is formed by laminating a plurality of thin plate members having a plurality of ink flow paths partially formed therein. Each ink flow path extends continuously so as to reach a nozzle opening from an ink supply section via a pressure producing chamber. In such an ink jet recording head, communicating holes formed in the respective thin plate members to enable the pressure producing chamber to communicate with the nozzle opening are linearly arranged. As a result of this construction, the ink from the pressure producing chamber can flow without stagnating in the communicating holes in the thin plate members, so that the air bubbles in the ink can be discharged from the nozzle openings effectively.

A second object of the invention in to provide an ink jet recording head which can be employed in a recording head having three or more nozzle opening arrays and which can minimize inter-line distance error to ensure high-quality printing.

To achieve the above objects, the invention provides an ink jet recording head having a plurality of nozzle openings arrays, arranged in an auxiliary scanning direction, which is substantially perpendicular to the main scanning direction. The nozzle opening arrays are divided into three groups and spaced at predetermined intervals in the main scanning direction.

In such an ink jet recording head, nozzle openings of the groups arranged on both sides of a group arranged in the middle of the recording head supplement spaces between these nozzle openings of the middle array. Furthermore, a nozzle opening of the group arranged in the middle is positioned uppermost or lowermost on the face of the print head, so that lines printed by the nozzle openings of the groups arranged on both sides interpose the lines printed by the nozzle openings of the middle group. As a result, the maximum distance between nozzle openings printing adjacent lines in the main scanning direction can be equal or substantially equal to half the maximum distance between the nozzle opening arrays at both sides of the print head. Therefore, inter-line positional error is reduced.

BRIEF DESCRIPTION OF THE DRAWINGS

These and other objects and advantages of the invention will become more apparent and more readily appreciated from the following detailed description of the presently preferred exemplary embodiments of the invention taken in conjunction with the accompanying drawings, of which.

DETAILED DESCRIPTION OF THE PREFERRED EMBODIMENTS

Figure 1:
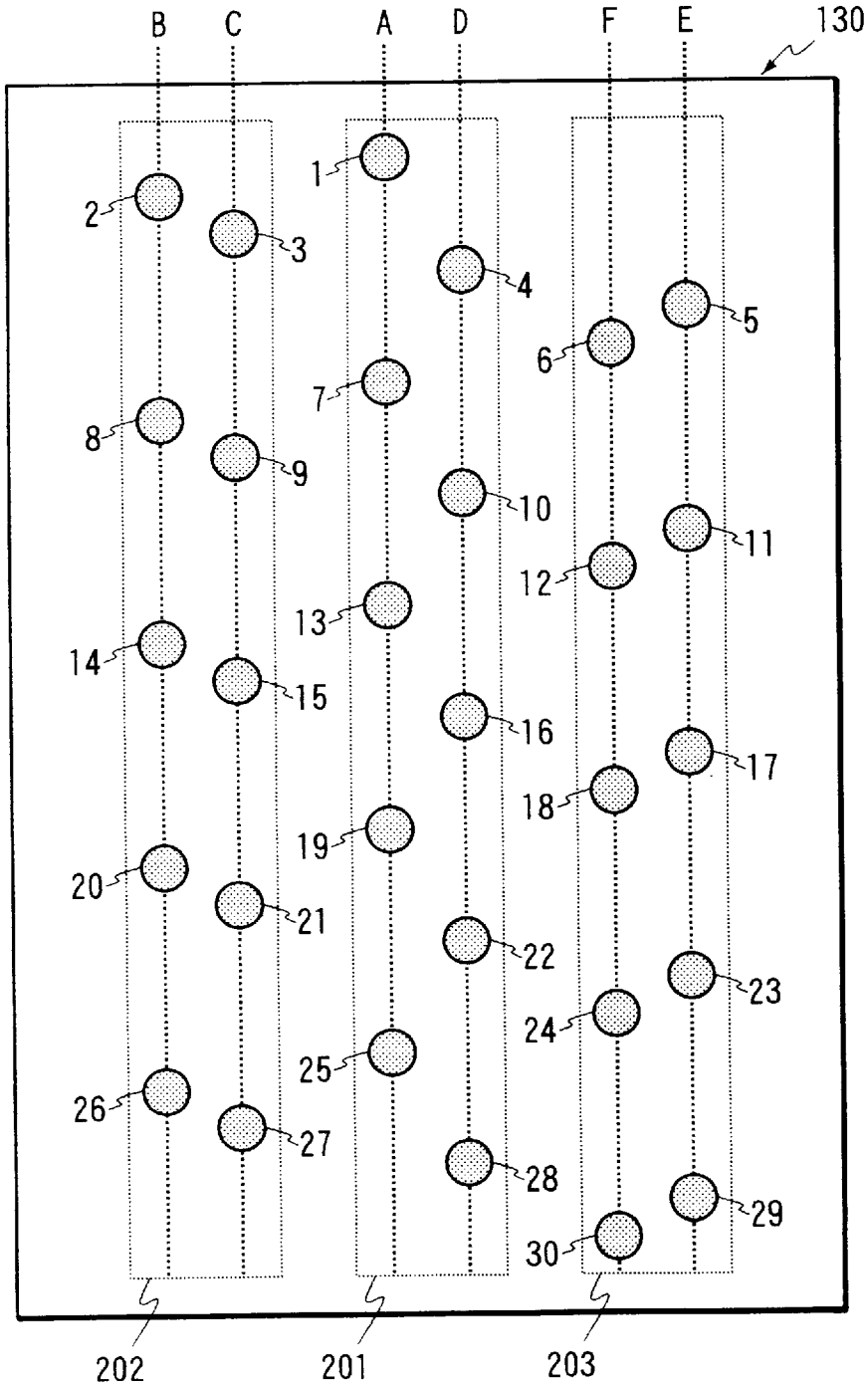
FIG. 1 illustrates an embodiment of the nozzle opening arrays of an ink jet recording head of the present invention.

FIG. 1 shown an exemplary embodiment of a nozzle opening arrangement of an ink jet recording head of the present invention. Nozzle plate 130 includes six arrays of nozzle openings A, B, C, D, E, F. The nozzle openings 1, 7, 13, 19 and, 25 of the first array A are positioned closest to the center line of the nozzle plate 130. Nozzle openings 2, 8, 14, 20 and 26 of the second array B are positioned close to one lateral end of the nozzle plate 130, for example, at the left end, and the nozzle openings 3, 9, 15, 21 and 27 of the third array C are positioned between the first array A and the second array B.

Nozzle openings 4, 10, 16, 32 and 28 of the fourth array D are positioned on a side of the first nozzle opening array A opposite to the side at which the third array is positioned. The nozzle openings 5, 11, 17, 23 and 29 of the fifth array E are positioned closest to the lateral end opposite to the lateral end at which the second array B is positioned, for example, the right end. Finally, the nozzle openings 6, 12, 18, 24 and 30 of the sixth array E are positioned closest to the fifth nozzle opening array E.

These nozzle opening arrays are divided into three groups. The first nozzle opening array A and the fourth nozzle opening array D constitute a first group 201. The second and third nozzle opening arrays B and C constitute a second group 202. The fifth and sixth nozzle opening arrays E and F constitute a third group 203. The nozzle openings of the respective groups 201, 202 and 203 communicate with the ink jet recording head unit, as shown in FIGS. 2, 3A and 3B, so that the nozzle openings are supplied with ink to be jetted.

The nozzle openings 1, 4, 7, 10, 13, 16, 19, 22, 25 and 28 of the first group 201 are arranged at a pitch of three dots apart in an auxiliary scanning direction, that is, in the vertical direction as viewed in FIG. 1. The pairs of nozzle openings 2 and 3, 8 and 9, 14 and 15, 20 and 21, and 26 and 27 of the second group 202 are arranged at a pitch of one dot apart, and are positioned in the vertical direction between or substantially between nozzle openings 1 and 4, 7 and 10, 13 and 16, 19 and 22, and 25 and 28, respectively. This pitch is repeated, for example, at a cycle of five pairs of dots.

The pairs of nozzle openings 5 and 6, 11 and 12, 17 and 18, 23 and 24, and 39 and 30 of the third group 203 are arranged at a pitch of one dot apart, and are positioned in the vertical direction between or substantially between nozzle openings 4 and 7, 10 and 13, 16 and 19, and 22 and 25, and in the vertical direction below or substantially below nozzle opening 28, respectively. This pitch is repeated, for example, at a cycle of five pairs of dots.

Figure 2:
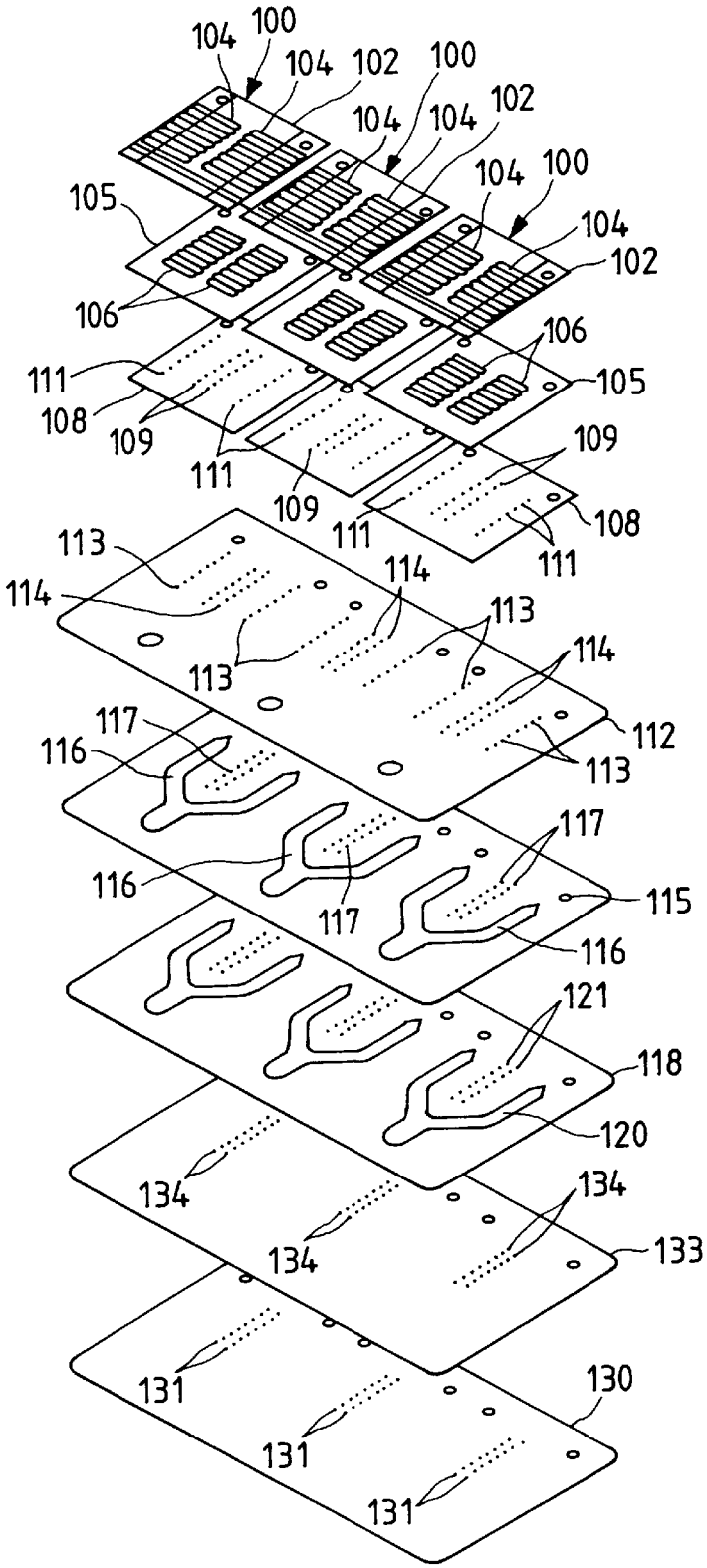
FIG. 2 is an exploded perspective view showing the detailed assembly of the ink jet recording head of FIG. 1.
Figure 3A:
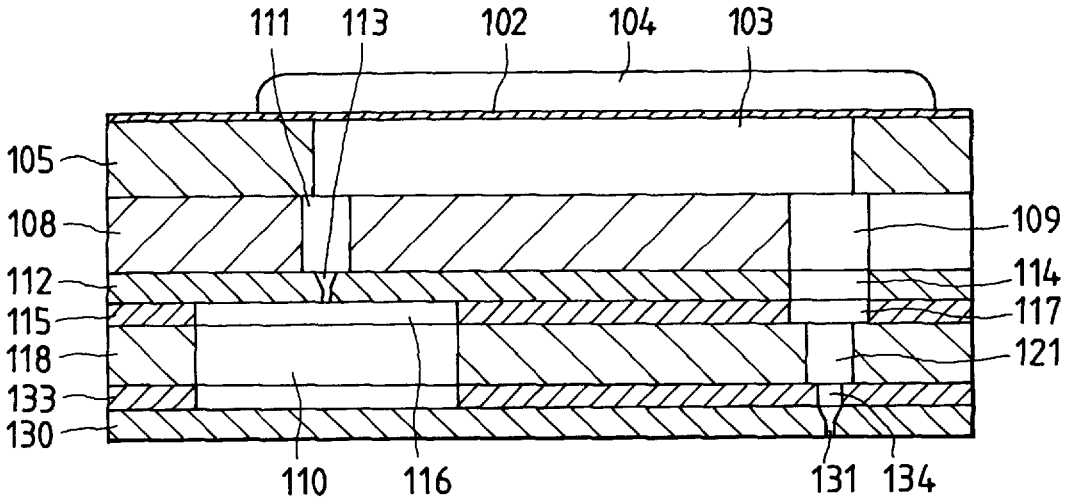
FIG. 3A is a sectional view showing the ink jet recording head of FIG. 1.
Figure 3B:
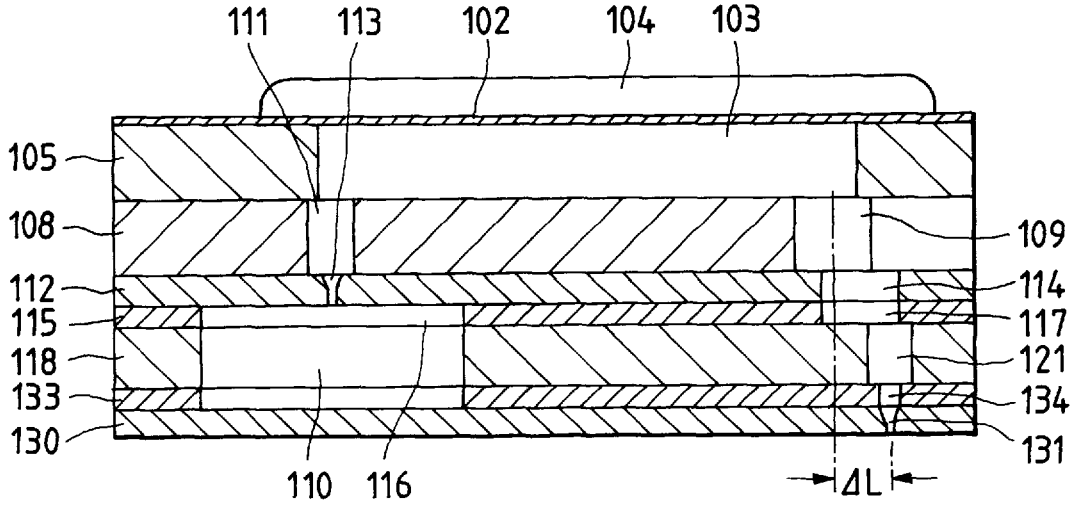
FIG. 3B is a sectional view showing another embodiment of the invention with the position of a nozzle opening shifted.

FIG. 2 is an exploded perspective view showing the assembly of an embodiment or the ink jet recording head of the present invention, as shown in FIG. 1. FIGS. 3A and 3B are sectional views, each showing a structure in the vicinity of a pressure producing chamber that is connected to a single common ink chamber.

As showing in FIG. 2, the ink jet recording head comprises piezoelectric vibration element drive sections 100, which are formed by mounting piezoelectric vibration plates 104, made of PZT or the like, onto a surface of a vibration plate 102 made of a zirconia ($ZrO_2$) thin plate member or the like whose thickness is about 10 $\mu$m. The piezoelectric vibrations plates 104 are mounted so as to oppose pressure producing chambers 103, which will be described below.

A spacer 105, which is made of a ceramic thin plate member, such as a 150 $\mu$m-thick zirconia thin plate member or the like, has through holes 106 therein. These through holes 106 constitute the pressure producing chambers 103, which are thus formed at a predetermined pitch. The shape of each through hole 106 coincides with that of the pressure producing chamber 103.

A board 108 is disposed adjacent the spacer 105 to close the corresponding ends of the pressure producing chambers 103. Introducing holes 109 and 111 are formed in board 108. Introducing holes 109 have a larger diameter than that of nozzle openings 131, which are formed in nozzle plate 130, and enable the nozzle openings 131 to communicate with corresponding pressure producing chambers 103. Introducing holes 111, on the other hand, enable their corresponding pressure producing chambers 103 to communicate with common ink chamber 110.

These three members 100, 105, 108 are integrated into a single structure, and are mounted on a unit fixing plate 112 by adhesive or the like. The unit fixing plate 112 also acts as a flow path regulating plate in this embodiment.

The unit fixing plate 112 includes flow path regulating holes 113, which are positioned between the introducing holes 111 and the common ink chamber 110 when the unit fixing plate 112 is mounted between the board 108 and the thermal deposition film 115, described below, as shown in FIG. 3B. Also, the unit fixing plate 112 includes introducing holes 114 which are positioned to oppose the through holes 109 when the unit fixing plate 112 is mounted to the board 108. Each flow path regulating hole 113 has a flow resistance substantially equal to that of the nozzle opening 131, and each introducing hole 114 enables the nozzle opening 131 to communicate with the pressure producing chamber 103.

The thermal deposition film 115 bonds a common ink chamber forming plate 118, described below, to the unit fixing plate 112. The thermal deposition film 115 includes windows 116 and introducing holes 117. Each window 116 coincides with the common ink chamber 110, and each introducing hole 117 enables the nozzle opening 131 to communicate with the pressure producing chamber 103.

The common ink chamber forming plate 118 includes windows 120 and introducing holes 121. The ink chamber forming plate 118 is, for example, a 150 $\mu$m-thick stainless steel plate member or the like, which in corrosion resistant and whose thickness is adequate to form the common ink chambers 110. Each window 120 is substantially V-shaped and thus corresponds to the shape of the common ink chamber 110. Each introducing hole 121 has a diameter larger than that of the nozzle openings 131, and enables their corresponding pressure producing chambers 103 to communicate with the nozzle openings 131.

As described above, the nozzle openings 131 are formed in the nozzle plate 130. The nozzle plate 130 is fixed to the common ink chamber forming plate 118 by a thermal deposition film 133 or the like, so that the nozzle openings 131 communicate with their respective pressure producing chambers 103 through introducing holes 109, 114, 117 and 121, and through hole 134 formed in the thermal deposition film 133. The diameter of these introducing holes 109, 114 and 121 is determined so that the opening at least on the side of the nozzle opening 131 is small.

Accordingly, the laminated structure allows the centers of the introducing holes 109, 114, 117 and 121 to be aligned, to allow the nozzle opening 131 to communicate with the pressure producing chamber 103 as shown in FIG. 3A. Hance, even it the nozzle opening 131 is shifted by a distance $\Delta L$, as shown In FIG. 3B, the ink is not likely to stagnate. Accordingly, air bubbles contained in the ink can be discharged swiftly from the nozzle opening.

Figure 4A:
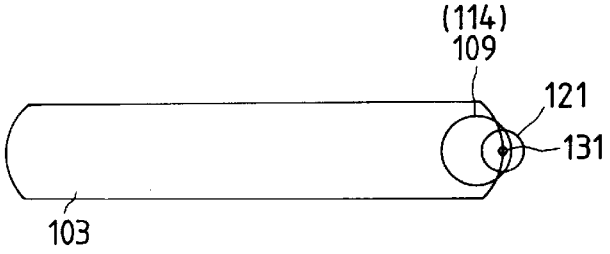
FIGS. 4A to 4D respectively show embodiments of the present invention wherein the position of a nozzle opening with respect to the corresponding pressure producing chamber is shifted by adjusting both the position of the nozzle opening and the positions of introducing holes connecting the nozzle opening to the pressure producing chamber in the embodiment of the ink jet recording head shown in FIG. 1.
Figure 4B:
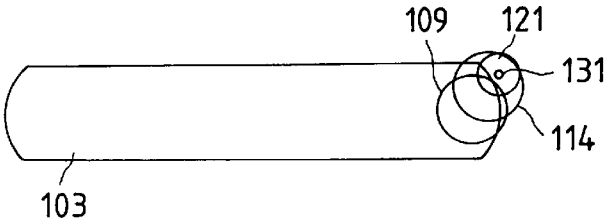
Figure 4C:
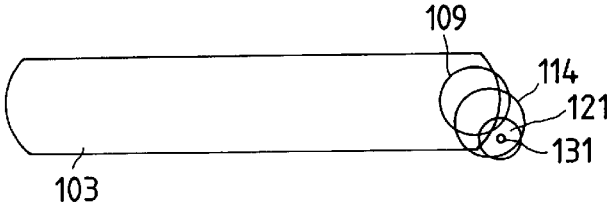

That is, if the nozzle openings 131 are shifted in a direction toward one end of the pressure producing chamber 103 as shown in FIG. 4A, the nozzle opening 131 can be aligned near the end of the pressure producing chamber 103. If the respective introducing holes 109, 114, 121, for example, are sequentially shifted in any direction with respect to the pressure producing chamber 103, as shown in FIGS. 4B, 4C, then the pitch between the adjacent nozzle openings 131 can be adjusted arbitrarily.

Figure 4D:
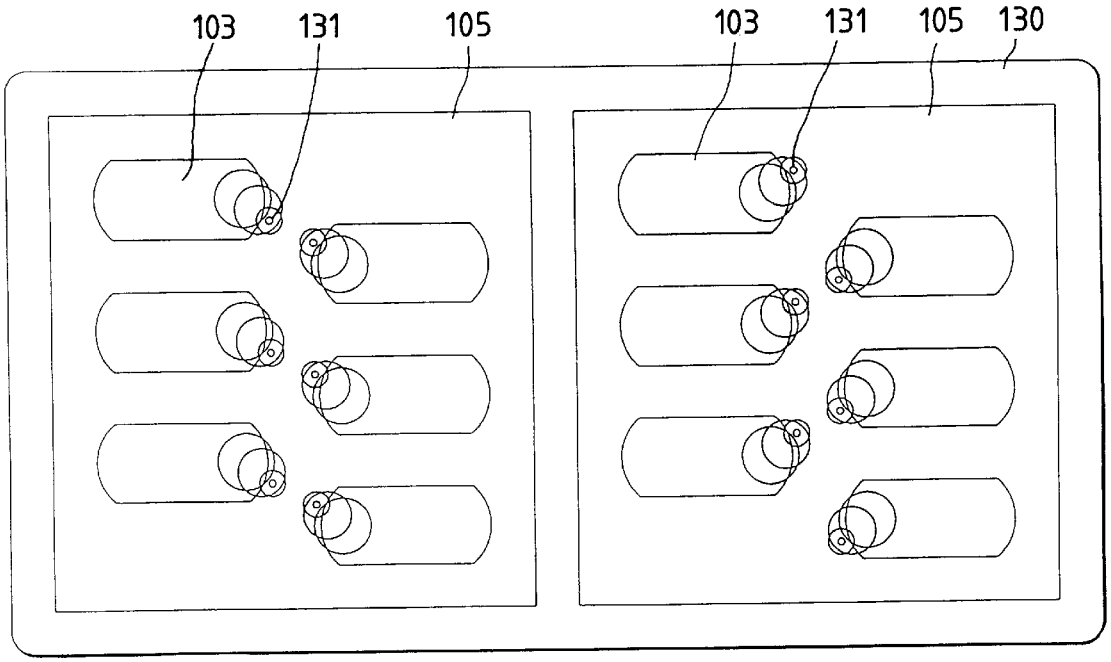

Alternatively, as shown in FIG. 4D, the pressure producing chambers 103 may be arranged to communicate with nozzle openings 131 which are positioned asymmetrically on the nozzle plate 130.

In the embodiment of the recording head of the present invention, when a drive signal is applied to the piezoelectric vibration plates 103, the vibration plate 102 is flexed, thereby causing the pressure producing chambers 103 to contract. As a result, the ink within the pressure producing chambers 103 in jetted to the nozzle openings 131 via the introducing holes 109, 114, 117 and 121, and is jetted therefrom in the form of an ink droplet.

When the drive signal is removed after the ink droplets have been jetted, the piezoelectric vibration plate 104 returns to its original position, thereby causing the pressure producing chamber 103 to expand to its original size. As a result, an amount of ink corresponding to the amount of ink jetted out of the nozzle openings 131 flows into the pressure producing chamber 103 from the common ink chamber 110 via the flow path regulating holes 113 and the introducing holes 111. This cycle is repeated until the amount of ink droplets necessary for printing have been jetted.

Operation of this embodiment of the recording head having the nozzle opening arrangement of the embodiment shown in FIG. 1 will now be described with reference to FIG. 5A.

Figure 5A:
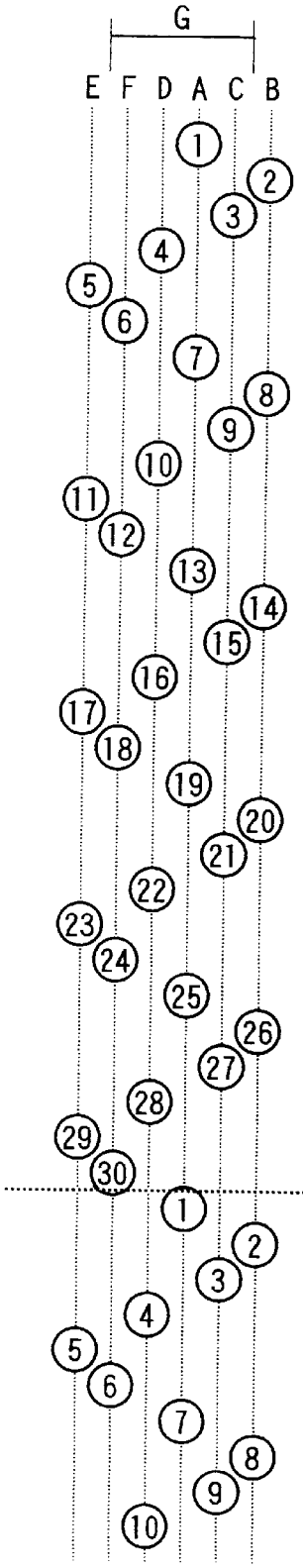
FIG. 5A illustrates a pattern printed by a recording head having nozzle opening arrays according to the present invention.

FIG. 5A is an exemplary diagram illustrating the correspondence between the position of lines printed in a print line (e.g, a single character line) in the horizontal direction and the nozzle openings that print such lines of the print line. This figure also illustrates the position of some of the nozzle openings that print the uppermost lines in an adjacent print line. The number in each circle corresponds to the number assigned to a nozzle opening in FIG. 1.

Lines in a print line are printed at an interval of three dots by the nozzle openings 1, 4, 7, 10, 13, 16, 19, 22, 25 and 28 of the nozzle opening arrays A and B of the first group 201. Two lines are printed by the nozzle openings 2, 3, 8, 9, 14, 15, 20, 21, 26 and 27 of the nozzle opening arrays B and C of the second group 202, so as to supplement lines between the odd-numbered nozzle openings and the even-numbered nozzle openings of the first group 201, i.e., between nozzle openings 1 and 4, 7 and 10, 13 and 16, 19 and 22, and 25 and 28.

Two lines are similarly printed by the nozzle openings 5, 6, 11, 12, 17, 18, 23, 24, 29 and 30 of the nozzle opening arrays E and F of the third group 203, so as to supplement the lines between the even-numbered nozzle openings and the odd-numbered nozzle openings of the first group 201, which are not supplemented by the second group 202, i.e., between nozzle openings 4 and 7, 10 and 13, 16 and 19, 22 and 25, and vertically below 28.

With the nozzle openings of the second and third groups 202 and 203, respectively, being arranged on both sides of the nozzle plate 130 to print lines which interpose the lines printed by the nozzle openings of the first group 201, arranged in the middle of the nozzle plate, the maximum distance in the main scanning direction between any two nozzle openings that print vertically adjacent lines is equal to half or substantially half the distance between groups 202 and 203 arranged on both sides of the nozzle plate 130. For this reason, an error that occurs when the vertical direction of the nozzle openings in the recording head is not parallel with the sheet forward direction, but is slightly at an angle with respect to the carriage, is substantially halved. That is, assuming that the distance in the main scanning direction between the nozzle opening arrays 202 and 203 is G, and that the angle of inclination of the head is θ, an error G×sinθ is substantially halved. In addition, since the nozzle openings are arranged so that the uppermost line in a print line is printed by a nozzle opening of the first group 201, that is, nozzle opening 1 in this embodiment, and the lowermost line in a print line is printed by a nozzle opening of either group 202 or 203 (i.e., nozzle opening 30 in this embodiment), the distance in the main scanning direction between the nozzle openings that prints the lowermost line of the print line (i.e., nozzle 30), and the upper most line of the next print line (i.e., nozzle 1), is also equal to half or substantially half the distance between groups 202 and 203. This, in turn, halves or substantially halves the error that may occur between the print lines that are printed before and after sheet forwarding, and thus prevents a white line or a black line from being produced, as often is the case in conventional printers.

Figure 5B:
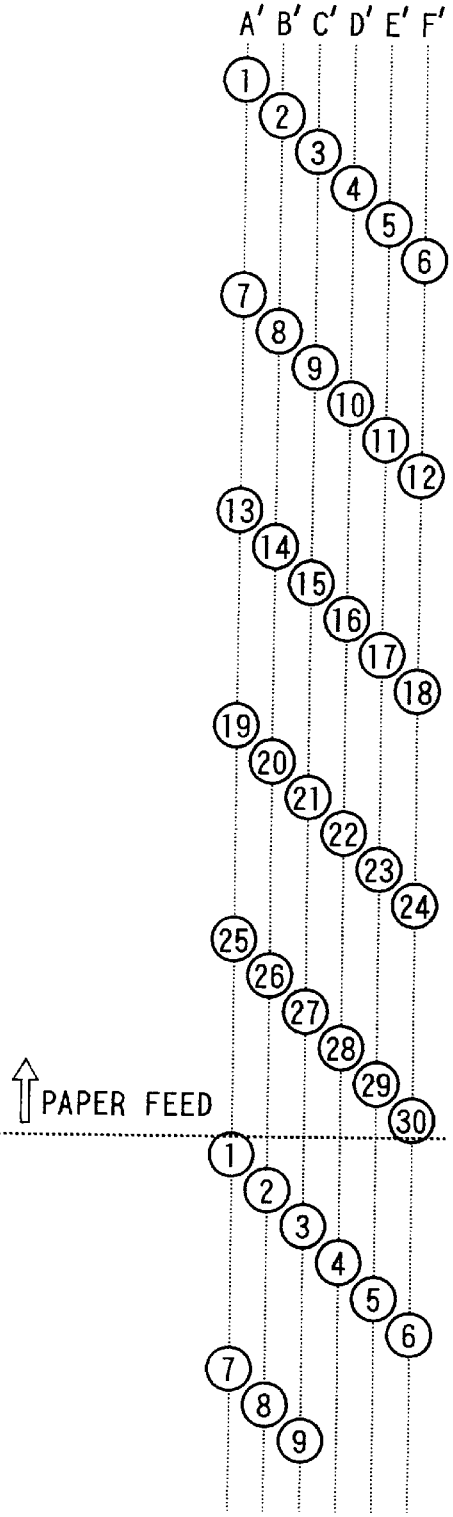
FIG. 5B illustrates a pattern printed by a recording head having nozzle opening arrays according to a conventional arrangement.

That is, in a conventional print head having a nozzle opening arrangement as shown in FIG. 5B, adjacent lines printed by the nozzle openings arranged on opposite sides of the print head (e.g., the nozzle openings 6 and 7 of the nozzle opening arrays A∝ and F∝) result in a large print error when the direction of the nozzle opening arrays A∝ through F∝ is not parallel to the sheet forwarding direction. This error occurs because the distance between these nozzle openings in the main scanning direction is equal to the distance between the nozzle opening arrays A∝ and F∝.

In addition, because this large distance in the main scanning direction exists between nozzle openings 1 and 30, when the direction of the nozzle opening arrays is not parallel to the sheet forwarding direction, a large error will occur between a print line and a subsequent print line printed after the sheet is forwarded.

Figure 6:
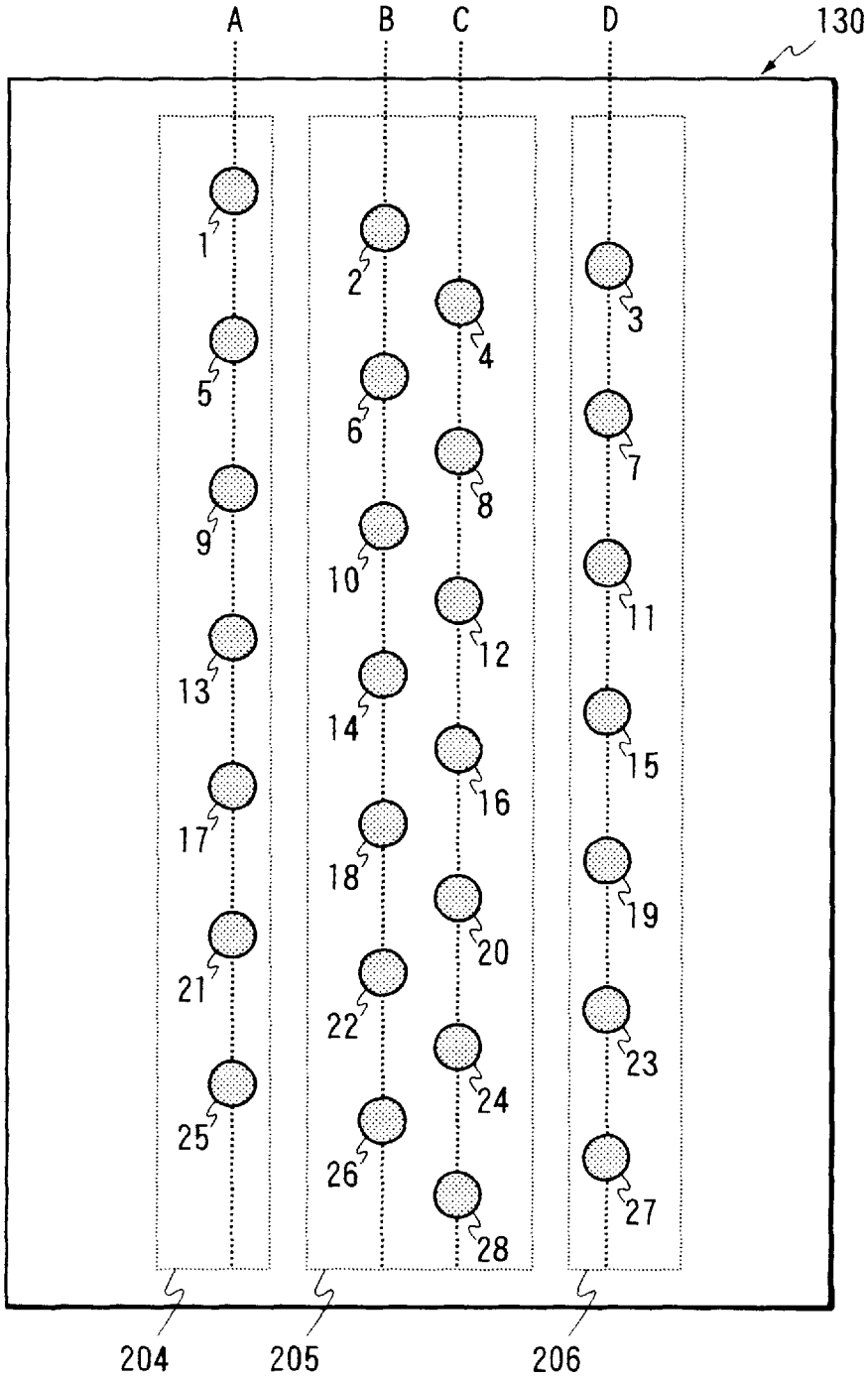
FIG. 6 illustrates another embodiment of the nozzle opening arrays of an ink jet recording head of the present invention.

FIG. 6 shows another embodiment of the nozzle opening arrangement according to the present invention. In a manner similar to the embodiment shown in FIG. 1, nozzle opening array groups 204, 205 and 206 are formed in a nozzle plate 130. The nozzle openings 1, 5, 9, 13, 17, 21 and 25 of the single array A of the first group 204 are arranged at a pitch of four dots apart in the sheet forwarding direction.

The second group 205 has two nozzle opening arrays B and C, each having nozzle openings spaced at a pitch of two dots from each other. The third group 206 has a single nozzle opening array D, wherein the nozzle openings are spaced at a pitch of four dots from each other.

The nozzle openings of the first and third groups 204 and 206 are arranged on opposite sides of the nozzle plate 130, and are positioned so as to alternately supplement the nozzle openings of the second group 205 arranged in the middle of the nozzle plate 130. That is, in this embodiment, lines printed by the nozzle openings 1, 5, 9, 13, 17, 21 and 25 of the first group 204 and lines printed by the nozzle openings 3, 7, 11, 15, 19, 23 and 27 of the third group 206 are printed so as to interpose lines printed by the nozzle openings 2, 4 . . . 26, 28 of the second group 205.

Therefore, the maximum distance between any two nozzle openings that print vertically adjacent lines is equal to or substantially equal to half the distance between the nozzle opening arrays A and D. In addition, since a nozzle opening of one of the groups 204 and 206 (i.e., nozzle opening 1 of group 204) is positioned to print the uppermost line of a print line, and the nozzle opening 28 of group 205 is positioned to print the lowermost line in the print line, the distance between the nozzle openings that print vertically adjacent print lines before and after sheet forwarding is equal or substantially equal to half the maximum distance between nozzle opening arrays 204 and 206. As in the embodiment of FIG. 1, this reduces errors that may occur (e.g., white line or black line) between adjacent print lines when the direction of the nozzle opening arrays is not parallel to the sheet feed direction.

Figure 7:
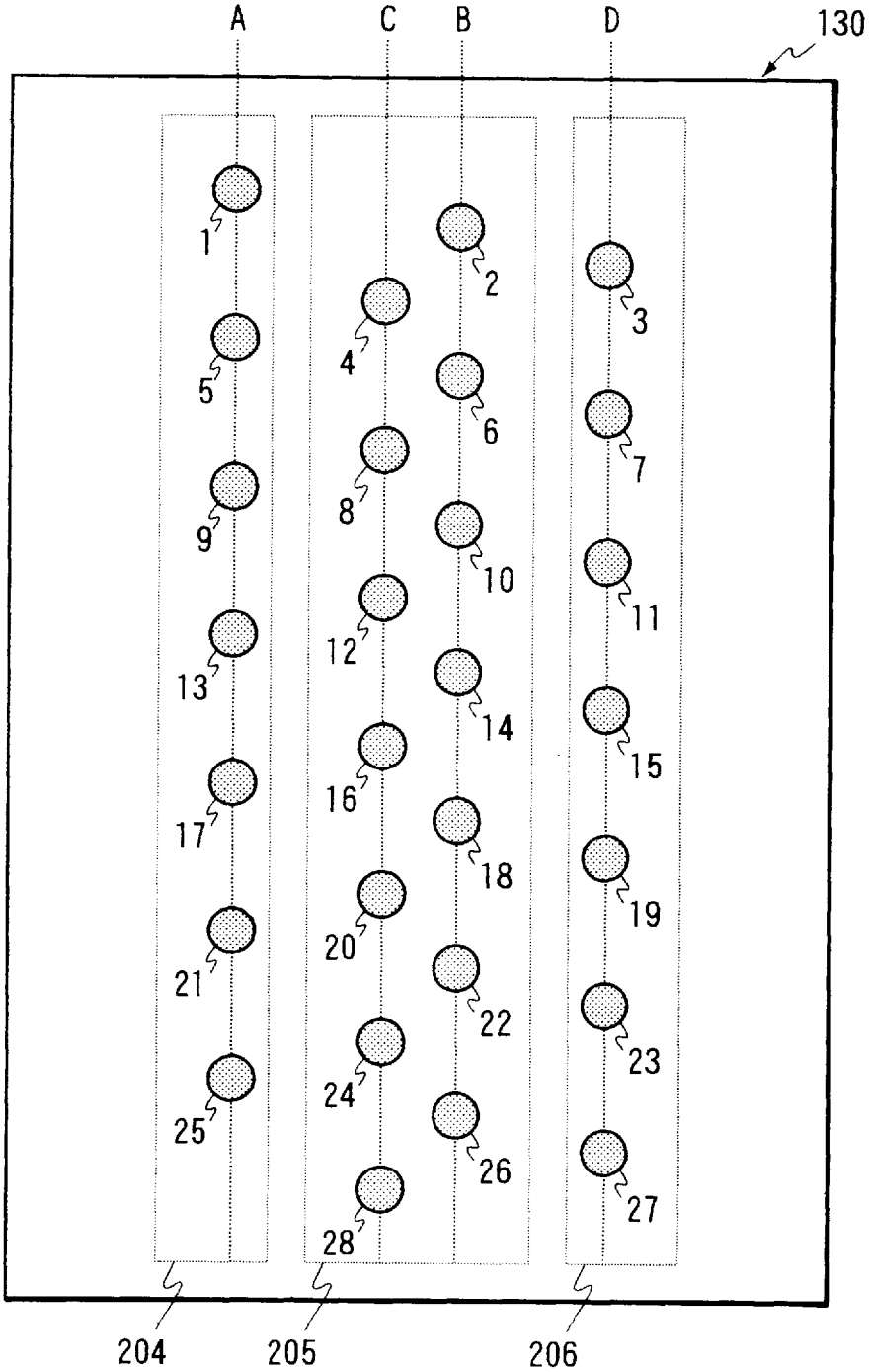
FIG. 7 illustrates a further embodiment of the nozzle opening arrays of an ink jet recording head of the present invention.

It is apparent that similar advantageous effects can be obtained by reversing the arrangement of the two nozzle opening arrays B and C of the second group 205, as shown in FIG. 7.

Figure 8:
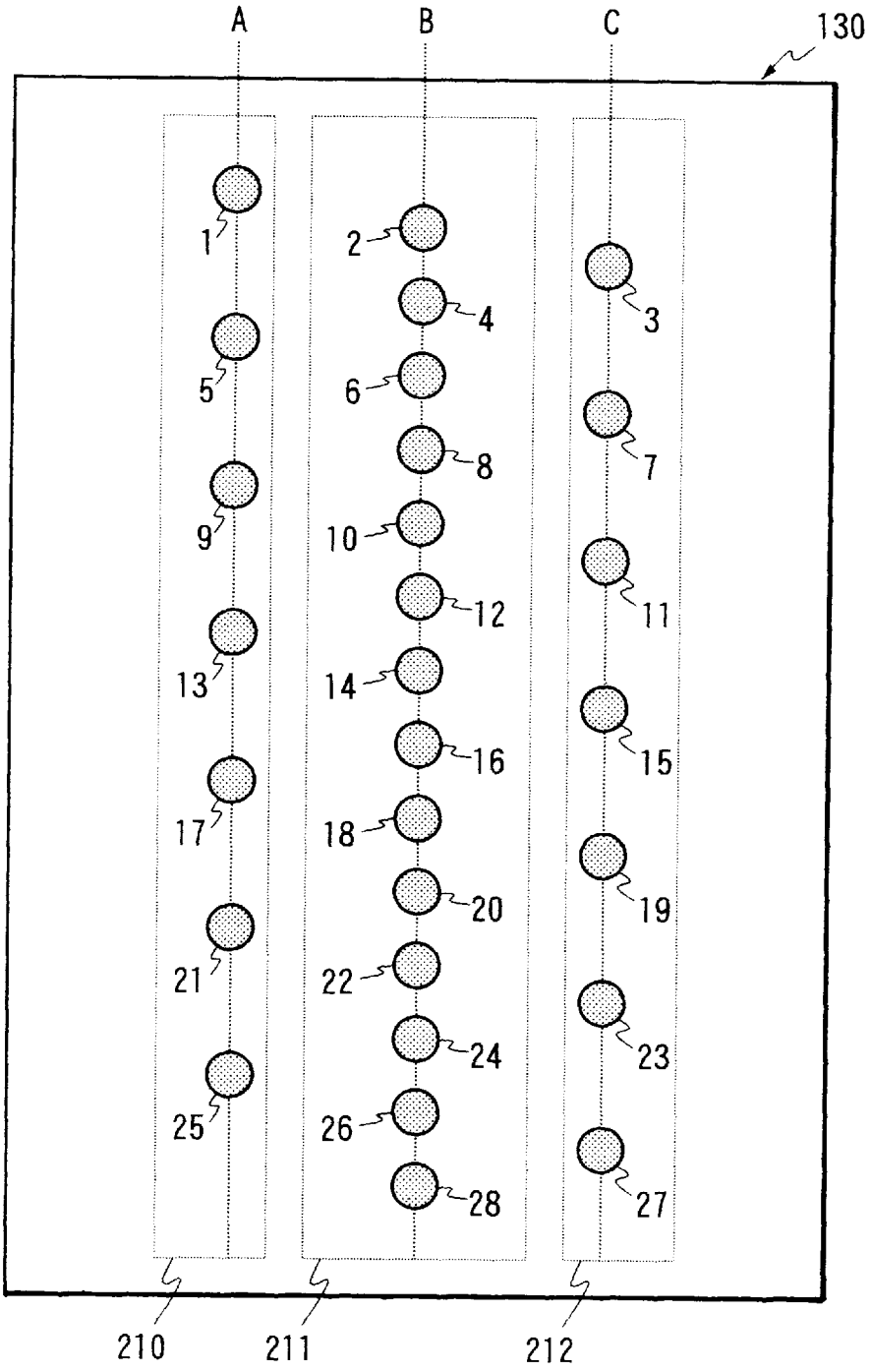
FIG. 8 illustrates a further embodiment of the nozzle opening arrays of an ink jet recording head of the present invention.

As shown in FIG. 8, a group 211 having the nozzle openings 2, 4, 6 . . . 24, 26, 28 arranged at a pitch of two dots apart from each other may be interposed between groups 210 and 212, which alternately supplement this group 211 during printing. Group 210 consists of a nozzle opening array A having the nozzle openings 1, 5 . . . 21, 25, arranged at a pitch of four dots from each other. Group 212, on the other hand, consists of a nozzle opening array C having the nozzle openings 3, 7 . . . 23, 27, arranged at a pitch of four dots from each other.

Figure 9:
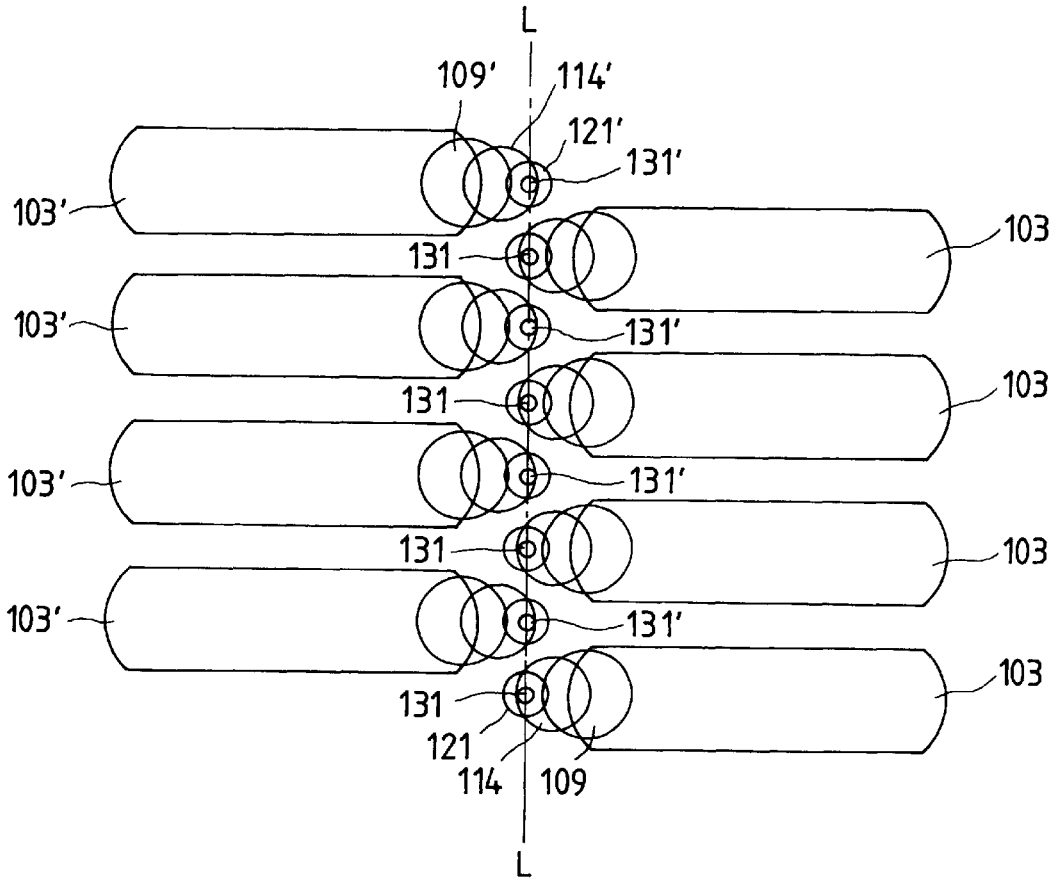
FIG. 9 illustrates an exemplary arrangement of introducing holes for implementing the pitch at which the nozzle openings are positioned as shown in the embodiment of FIG. 8.

When the nozzle openings are linearly arranged at an extremely high density as in nozzle opening array B of the group 211, two arrays of pressure producing chambers 103 and 103' are used, as shown in FIG. 9. These chambers 103 and 103' are arranged so that their adjacent ends are as close as possible to the positions at which their respective nozzle opening is disposed (i.e., as close as possible to line L—L). Also, introducing holes 109, 114, 121, providing communication between the pressure producing chambers 103 and the nozzle openings 131, and introducing holes 109', 114', 121', providing communication between pressure producing chambers 103' and nozzle openings 131', are shifted toward the line L—L.

Also in this embodiment, as in the aforementioned embodiment, the lines printed by the nozzle openings 2, 4, 6 . . . 24, 26, 28 of the nozzle opening array B are alternately supplemented by the lines printed by the nozzle openings 1, 5, 9 . . . 21, 25 of the nozzle opening array A and by the nozzle openings 3 7, 11 . . . 23, 27 of the nozzle opening array C, arranged at opposite sides of the nozzle plate 130. Furthermore, the nozzle opening 1 of group 210 is positioned uppermost, and nozzle opening 28 of group 212 is positioned lowermost, thereby reducing errors that can occur between print lines as discussed in the previous embodiments.

Furthermore, each ink flow path is formed so as to smoothly connect the introducing holes 109, 114, 121 and the introducing holes 109', 114', 121' that are formed in the respective thin plate members, so as to be tapered toward the nozzle opening. Therefore, the ink is not likely to stagnate, and air bubbles contained in the ink are effectively discharged.

While in the embodiments shown in FIGS. 6, 7, and 8, a nozzle opening of the nozzle opening arrays of groups 205 and 211, positioned in the middle of the nozzle plate 130, is positioned at the lowermost end of the recording head, it is apparent that similar effects can be provided by alternately positioning a nozzle opening of groups 205 and 211 at the uppermost end of the recording head. For example, in the embodiment shown in FIG. 6, the nozzle opening array A of group 204 can be shifted down by four dots. That is, nozzle opening 1 can be set to the position of the nozzle opening 5, and printing can be performed in the order of the currently assigned nozzle opening numbers, i.e., 2, 3, 4, 5, . . . 27, 28.

Further, with respect to the embodiments shown in FIGS. 7 and 8, it is apparent that printing can be done starting with the nozzle opening 2 of the nozzle opening array B by either omitting the uppermost nozzle opening 1 of the nozzle opening array A of the group 204 or 210 shown in FIG. 7 and 8, respectively, or by not using nozzle opening 1.

Figure 10:
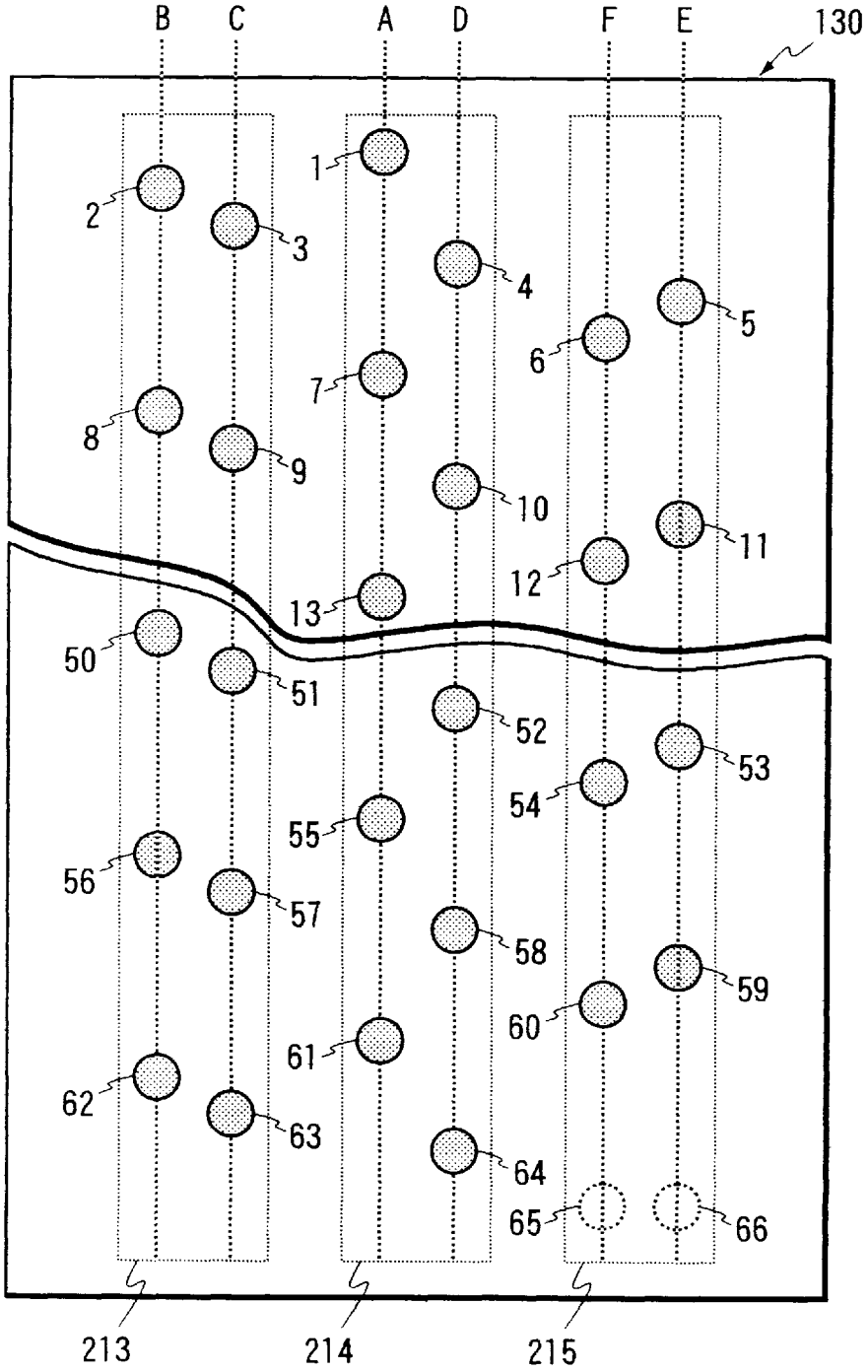
FIG. 10 illustrates a further embodiment of the nozzle opening arrays of an ink jet recording head of the present invention.

If the number of nozzle openings in the nozzle opening array other than that of the group in the middle is decreased as described above, then the number of nozzle openings of the nozzle opening array A of group 204 in FIG. 7, or of group 210 in FIG. 8, is decreased to 6, thus leaving nozzle opening array A short one nozzle opening compared with group 206 in FIG. 7 or group 212 in FIG. 8. This, in turn, allows the nozzle openings of group 205 or 210 in the middle of the nozzle plate to be positioned uppermost and lowermost. As a result, the nozzle opening that prints the last line of a print line and the nozzle opening that prints the first line of a next print line belong to the same group, which in turn allows printing quality to be improved. FIG. 10 shows an embodiment of an ink jet recording head according to the present invention having this type of nozzle opening arrangement. This embodiment is suitable for a recording head capable of extremely high-density printing with a particularly great number of nozzle openings, e.g., 64 nozzle openings, formed on a single nozzle plate.

The nozzle openings of the recording head (from the uppermost nozzle opening 1 to the lowermost nozzle opening 64) are arranged at the same pitch as those in the embodiment of FIG. 1 in nozzle opening arrays A and D of group 214 arranged in the middle of the nozzle plate. As a result of this arrangement, one of the groups at the sides of the nozzle plate has two less nozzle openings. For example, nozzle openings 65 and 66 in group 215 arranged on the right side, as shown in FIG. 10, are removed.

According to this embodiment, the lowermost line of a print line (e.g., a single row of characters) is printed by nozzle opening 64 in the middle and the uppermost line of a next row is printed by the nozzle opening 1 of group 214 also in the middle. Therefore, not only can inter-line error, as described above, be minimized, but also high quality printing can be implemented in a solid image, such as a graphic image, when printing is done by using a part of the upper side of the recording head when, for example, the last line of such solid image is to be printed, because the nozzle opening 64 that prints the lowermost line of the penultimate row and the nozzle opening 1 that prints the uppermost line of the last row belong to group 214 in the middle of the nozzle plate.

While a single group consists of one or two nozzle opening arrays in the aforementioned embodiments, it is apparent that similar effects can be obtained by putting three or more nozzle opening arrays in a single group. Further, while a recording head utilizing flexural vibration is described in the above embodiments, it is apparent that similar effects and advantages can be obtained by employing a piezoelectric vibration element of the vertical mode, in which the distance between nozzle opening arrays can be made relatively small.

While the invention has been particularly shown and described with reference to preferred embodiments thereof, it will be understood by those skilled in the art that various changes in form and details may be made therein without departing from the spirit and scope of the invention.

What is claimed is:

1. An ink jet recording head comprising:

a board having a plurality of nozzle openings therein arranged in nozzle opening arrays formed in an auxiliary scanning direction, the nozzle opening arrays being divided into three groups at a predetermined interval in a main scanning direction, wherein a distance between nozzle opening arrays within each group of nozzle opening arrays is less than a distance between each group of nozzle arrays, said nozzle openings of groups arranged at both sides of a middle one of said three groups in the main scanning direction of the ink jet recording head being positioned vertically between adjacent nozzle openings of the middle one of said three groups; and a nozzle opening of the middle one of said three groups being positioned uppermost or lowermost in the auxiliary scanning direction, so that lines printed by the nozzle openings of the groups arranged at both sides interpose lines printed by the nozzle openings of the middle one of said three groups.

2. An ink jet recording head according to claim 1, wherein each group has two nozzle opening arrays, the nozzle openings of the middle group being pitched at an interval of three dots in the auxiliary scanning direction, pairs of nozzle openings of the groups arranged on both sides are pitched at an interval of one dot, and said pairs are arranged at an interval of five dots so as to be positioned vertically between said nozzle openings of the middle group.

3. An ink jet recording head according to claim 1, wherein the nozzle openings of the middle group are pitched at an interval of two dots, each of the groups arranged on both sides of the middle group has a single nozzle opening array having nozzle openings pitched at an interval of four dots so as to be vertically between the nozzle openings of the middle group.

4. An ink jet recording head according to claim 3, wherein the middle group has two nozzle opening arrays.

5. An ink jet recording head according to claim 3, wherein the middle group has a single nozzle opening array.

6. An ink jet recording head comprising:

a board having a plurality of nozzle openings therein arranged in nozzle opening arrays being divided into three groups at a predetermined interval in a main scanning direction, wherein a distance between nozzle opening arrays within each group of nozzle opening arrays is less than a distance between each group of nozzle arrays, said nozzle openings of groups arranged at both sides of a middle one of said three groups in the main scanning direction of the ink jet recording head being positioned vertically between adjacent nozzle openings of the middle one of said three groups; and a nozzle opening of the middle one of said three groups being positioned uppermost and lowermost in the auxiliary scanning direction, so that lines printed by the nozzle openings of the groups arranged at both sides interpose lines printed by the nozzle openings of the middle one of said three groups.

* * * * *